US010656561B1

(12) United States Patent
Watanabe

(10) Patent No.: US 10,656,561 B1
(45) Date of Patent: May 19, 2020

(54) TONER CONVEYING DEVICE, AND DEVELOPING DEVICE AND IMAGE FORMING APPARATUS THEREWITH

(71) Applicant: KYOCERA Document Solutions Inc., Osaka (JP)

(72) Inventor: Akihiro Watanabe, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/576,464

(22) Filed: Sep. 19, 2019

(30) Foreign Application Priority Data

Nov. 5, 2018 (JP) ..... 2018-208287

(51) Int. Cl.
*G03G 15/08* (2006.01)
*G03G 21/10* (2006.01)

(52) U.S. Cl.
CPC ..... *G03G 15/0891* (2013.01); *G03G 21/105* (2013.01)

(58) Field of Classification Search
CPC ..... G03G 15/0879; G03G 15/0891; G03G 21/105
See application file for complete search history.

(56) References Cited

U.S. PATENT DOCUMENTS 5,111,247 A * 5/1992 Nichols ..... G03G 15/0849 366/142
2013/0017001 A1 1/2013 Yamanaka ..... 399/258
2014/0076691 A1* 3/2014 Yamada ..... G03G 15/0189 198/548
2018/0253030 A1* 9/2018 Sako ..... G03G 15/0872
2019/0113884 A1* 4/2019 Fuse ..... G03G 21/1842

FOREIGN PATENT DOCUMENTS

JP 2005091854 A * 4/2005
JP 2008-216360 A 9/2008
JP 2013-20209 A 1/2013

* cited by examiner

*Primary Examiner* — Sevan A Aydin
(74) *Attorney, Agent, or Firm* — Stein IP, LLC

(57) ABSTRACT

A toner conveying device includes a toner conveying portion having vertical and horizontal conveying portions, a conveying member arranged in the horizontal conveying portion, a toner loosening member, and first and second magnetic members. The toner loosening member is arranged in the vertical conveying portion to be movable vertically. The first magnetic member is attached to the bottom end of the toner loosening member. The second magnetic member is attached to a part of the conveying member facing the toner loosening member. The magnetic pole of the first magnetic member on its side facing the conveying member is the same as the magnetic pole of the second magnetic member on its side facing the toner loosening member. The toner loosening member vertically reciprocates as the repulsive magnetic field between the first and the second magnetic members changes periodically with the rotation of the conveying member.

7 Claims, 5 Drawing Sheets

TONER CONVEYING DEVICE, AND DEVELOPING DEVICE AND IMAGE FORMING APPARATUS THEREWITH

INCORPORATION BY REFERENCE

This application is based upon and claims the benefit of priority from the corresponding Japanese Patent Application No. 2018-208287 filed on Nov. 5, 2018, the entire contents of which are incorporated herein by reference.

BACKGROUND

The present disclosure relates to toner conveying devices for conveying toner. More particularly, the present disclosure relates to toner conveying devices provided with a toner conveying portion in which a horizontal conveying portion is connected to a bottom end part of a vertical conveying portion for making toner fall vertically, and to developing devices and image forming apparatuses provided with such a toner conveying device.

Image forming apparatuses such as electrophotographic printers and copiers include a photosensitive drum which carries an electrostatic latent image, a developing device which feeds toner to the photosensitive drum to develop the electrostatic latent image into a toner image, and a toner container which feeds toner to the developing device. In some color image forming apparatuses, a layout in which an intermediate transfer unit is provided between the toner container and the developing device is adopted. In this case, since the toner container is away from the developing device, a toner conveying portion for conveying toner from a toner discharge port of the toner container to a toner receiving port of the developing device is provided.

Here, when the toner container can be arranged right above the developing device, only a vertical conveying portion for making toner fall vertically has to be provided in the toner conveying portion. However, when it is difficult to arrange the toner container right above the developing device due to limitations in layout, a horizontal conveying portion for conveying toner horizontally is required in the toner conveying portion in addition to the vertical conveying portion. In the horizontal conveying portion, a conveying screw for conveying toner is arranged.

In the toner conveying portion in which the horizontal conveying portion is connected to the vertical conveying portion, inconveniently, toner can agglomerate around the bottom end part (the connecting part with the conveying passage) of the vertical conveying portion to hamper smooth toner feeding. This is caused by toner agglomerates blocking the conveying passage resulting from the toner around the bottom end of the vertical conveying portion being pushed back upward by the rotation of the conveying screw.

To solve the problem mentioned above, there is a known technique of fitting a twisted coil spring that vibrates with the rotation of the conveying screw to the conveying screw. With this configuration, it is possible to prevent toner from agglomerating in the vibrating range of the twisted coil spring.

With the above method, it is not possible to loosen toner agglomerates generated above the vibration range of the twisted coil spring. Since it is difficult to make a long twist coil spring for such use, a method for reliably loosening toner in the vertical conveying portion has been sought.

Thus, there is a known configuration where a swingable ball which can make contact with both the toner loosening member and the conveying screw is arranged near the connecting part between the vertical and horizontal conveying portions. With this configuration, the contact portion of the swingable ball changes between the screw shaft of the conveying screw and the blade portion of the conveying screw as the conveying screw rotates and this makes the toner loosening member swing vertically.

SUMMARY

A toner conveying device according to one aspect of the present disclosure includes a toner conveying portion, a conveying member, a toner loosening member, and first and second magnetic members. The toner conveying portion includes a vertical conveying portion which conveys toner by making toner fall vertically and a horizontal conveying portion which is connected to a bottom end part of the vertical conveying portion to convey toner horizontally. The conveying member includes a rotary shaft arranged in the horizontal conveying portion along the conveying direction of the toner and a conveying projection which is provided around the outer circumferential face of the rotary shaft. The conveying member conveys, with the conveying projection while rotating the rotary shaft, the toner in the horizontal conveying portion in the axial direction of the rotary shaft. The toner loosening member is arranged in the vertical conveying portion to be movable vertically. The first magnetic member is attached to a bottom end part of the toner loosening member. The second magnetic member is attached to a part of the conveying member at its part facing the toner loosening member. The magnetic pole of the first magnetic member on its side facing the conveying member is the same as the magnetic pole of the second magnetic member on its side facing the toner loosening member. The toner loosening member vertically reciprocates as the repulsive magnetic field between the first and the second magnetic members changes periodically with the rotation of the conveying member.

This and other objects of the present disclosure, and the specific benefits obtained according to the present disclosure, will become apparent from the description of embodiments which follows.

DETAILED DESCRIPTION

Figure 1:
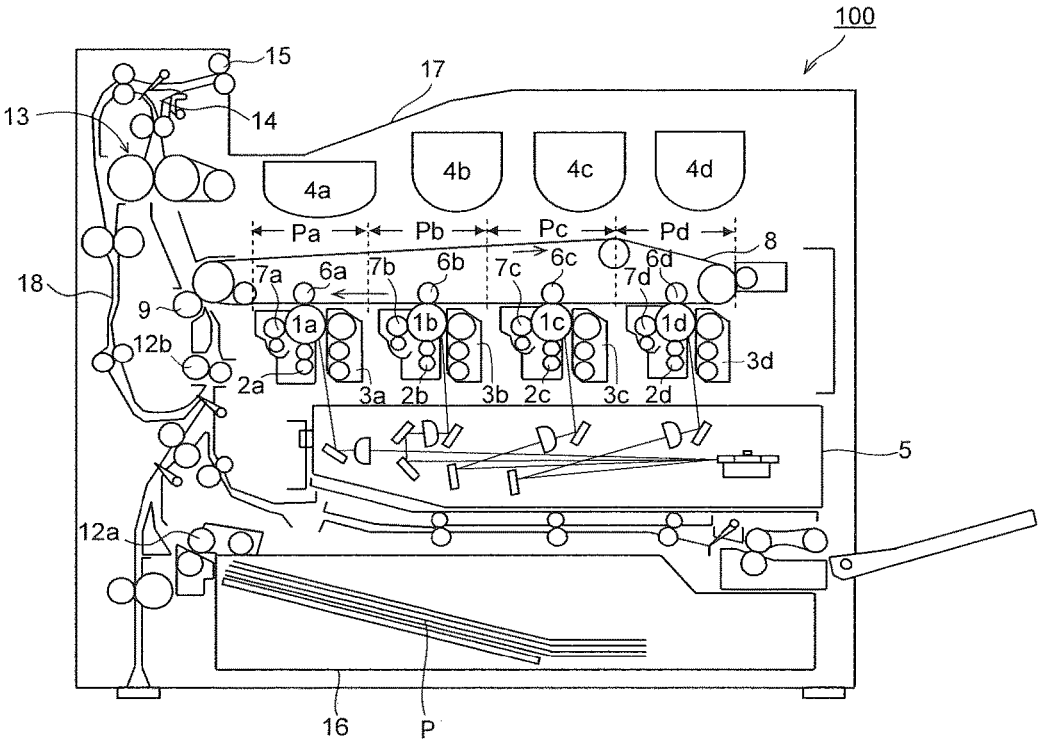
FIG. 1 is a schematic sectional view showing an overall construction of a color printer provided with a developing device to which a toner feeding portion according to the present disclosure is connected.

Hereinafter, with reference to the accompanying drawings, embodiments of the present disclosure will be described. FIG. 1 is a schematic sectional view of a color printer 100 including developing devices 3*a* to 3*d* to which a toner feeding portion 24 (see FIG. 3) according to the present disclosure is connected. Here, a tandem-type color printer is illustrated. In the main body of the color printer 100, four image forming portions, Pa, Pb, Pc and Pd are arranged in the order from Pd to Pa from the upstream side in the conveying direction (from the right side in FIG. 1). These image forming portions Pa to Pd are provided so as to correspond to images of four different colors (black, yellow, magenta, and cyan) and sequentially form images of cyan, magenta, yellow, and black through the processes of electrostatic charge, exposure, development, and transfer.

In these image forming portions Pa to Pd, photosensitive drums 1*a*, 1*b*, 1*c*, and 1*d* are respectively arranged which carry visible images (toner images) of different colors. Further, an intermediate transfer belt 8 which rotates clockwise in FIG. 1 is provided adjacent to the image forming portions Pa to Pd.

When image data is input from a host device such as a personal computer, first, the surfaces of the photosensitive drums 1*a* to 1*d* are electrostatically charged uniformly by charging devices 2*a* to 2*d*. Next, an exposure device 5 irradiates the photosensitive drums 1*a* to 1*d* with light based on image data to form on them electrostatic latent images reflecting the image data. To the developing devices 3*a* to 3*d*, a predetermined amount of two-component developer (hereinafter also referred to simply as developer) containing black, yellow, magenta, and cyan toner is charged from toner containers 4*a* to 4*d*. The developing devices 3*a* to 3*d* feed the photosensitive drums 1*a* to 1*d* with toner in the developer, which electrostatically adheres to the photosensitive drums 1*a* to 1*d*. In this way, toner images corresponding to the electrostatic latent images formed through exposure to light from the exposure device 5 are formed.

Then, by primary transfer rollers 6*a* to 6*d*, electric fields with a predetermined transfer voltage are applied between the primary transfer rollers 6*a* to 6*d* and the photosensitive drums 1*a* to 1*d*, and the black, yellow, magenta, and cyan toner images on the photosensitive drums 1*a* to 1*d* are primarily transferred to the intermediate transfer belt 8. Toner and the like left on the surface of the photosensitive drums 1*a* to 1*d* after the primary transfer is removed by cleaning devices 7*a* to 7*d*.

A transfer paper P to which a toner image is to be transferred is stored in a sheet cassette 16 arranged in a lower part in the color printer 100. The transfer paper P is conveyed via a sheet feeding roller 12*a* and a registration roller pair 12*b* to, with predetermined timing, a nip portion (secondary transfer nip portion) between a secondary transfer roller 9 provided adjacent to the intermediate transfer belt 8 and the intermediate transfer belt 8. The transfer paper P on which a toner image has been secondarily transferred is conveyed to a fixing portion 13.

The transfer paper P conveyed to the fixing portion 13 is heated and pressed by a fixing roller pair, and thereby the toner image is fixed on the surface of the transfer paper P to form a predetermined full-color image. The transfer paper P on which a full-color image has been formed is directly (or after being directed to a reversing conveying passage 18 by a branch portion 14 to have images formed on both its faces) discharged to a discharge tray 17 by a discharge roller pair 15.

Figure 2:
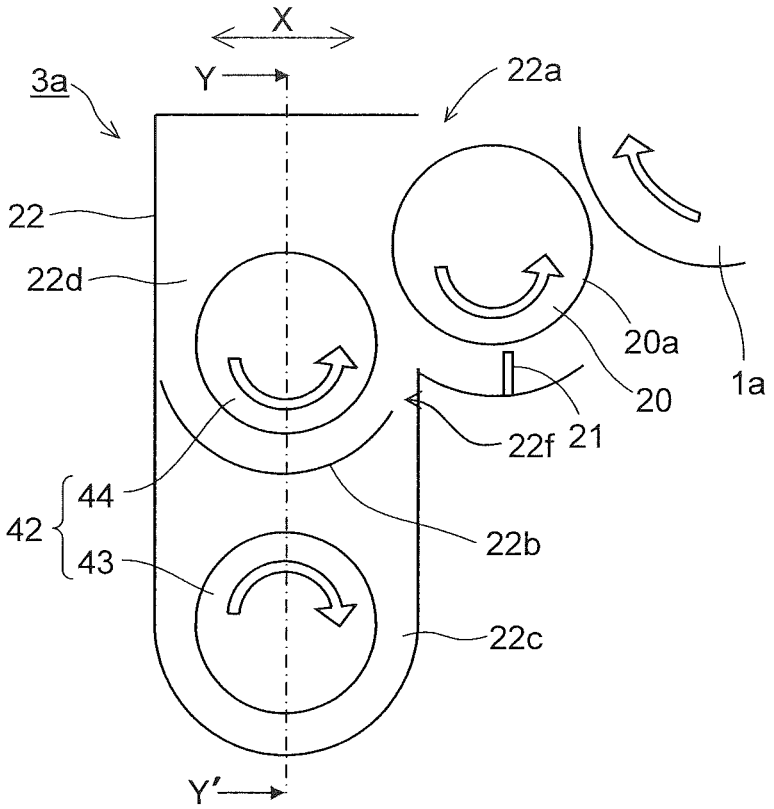
FIG. 2 is a side sectional view showing the structure of the developing device incorporated in the color printer.

FIG. 2 is a side sectional view showing the structure of the developing device 3*a* incorporated in the color printer 100. Here, a description will be given of the developing device 3*a* arranged in the image forming portion Pa in FIG. 1. The structure of the developing devices 3*b* to 3*d* arranged in the image forming portions Pb to Pd are basically similar to that of the developing device 3*a*, and thus no overlapping description will be repeated. FIG. 2 is a view of the developing device 3*a* as seen from behind of what is shown in FIG. 1, and accordingly, in FIG. 2, the arrangement of components inside the developing device 3*a* is reversed left to right as compared with that in FIG. 1. As shown in FIG. 2, the developing device 3*a* includes a developing roller (a developer career) 20, a stirring/transporting member 42, and a developer container 22 in which those are housed.

The developer container 22 forms the housing of the developing device 3*a* and is partitioned into first and second conveying chambers 22*c* and 22*d* by a partition portion 22*b*. In the first and second conveying chambers 22*c* and 22*d*, a two-component developer containing carrier and toner is stored. The developer container 22 rotatably holds the stirring/transporting member 42 and the developing roller 20. In the developer container 22, an opening 22*a* is formed through which the developing roller 20 is exposed toward the photosensitive drum 1*a*.

The stirring/transporting member 42 is composed of two spirals, namely, a first spiral 43 and a second spiral 44. The first spiral 43 is provided in the first conveying chamber 22*c*. The second spiral 44 is provided in the second conveying chamber 22*d* arranged above the first conveying chamber 22*c*.

The first and second spirals 43 and 44 stir developer to electrostatically charge toner in the developer to a predetermined level. This permits the toner to be held on the carrier. In both end parts, in the longitudinal direction (the direction perpendicular to the plane of FIG. 2), of the partition portion 22*b* which partitions the first and second conveying chambers 22*c* and 22*d*, communication portions (first and second communication portions 22*e* and 22*f* in FIG. 3) are provided respectively. When the first spiral 43 rotates, electrostatically charged developer is conveyed from one communication portion (the first communication portion 22*e*) provided in the partition portion 22*b* to the second conveying chamber 22*d* and from the other communication portion (the second communication portion 22*f*) to the first conveying chamber 22*c*, so that the developer circulates through the first and second conveying chambers 22*c* and 22*d*. The developer is then fed from the second spiral 44 to the developing roller 20 to form a magnetic brush on the developing roller 20.

The developing roller 20 includes a fixed shaft (unillustrated) and a developing sleeve 20*a*. A magnet (unillustrated) having a plurality of magnetic poles is fixed to the fixed shaft, and the developing sleeve 20*a* is rotatably supported on the fixed shaft. Near the developing sleeve 20*a*, a regulating blade 21 is provided which is arranged at a predetermined distance from the developing sleeve 20*a* to regulate the layer thickness of the magnetic brush on the surface of the developing sleeve 20*a*. The developing sleeve 20*a* rotates in the direction indicated by an arrow in FIG. 2 (counter-clockwise) by a driving mechanism comprising a motor and gears, of which none is illustrated. To the developing sleeve 20*a*, a developing bias produced by superimposing an alternating-current voltage on a direct-current voltage is applied.

As the developing sleeve 20*a* with a development bias applied to it rotates counter-clockwise in FIG. 2, the difference between the potential of the developing bias and the potential at the exposed part of the photosensitive drum 1*a* causes the toner carried on the surface of the developing sleeve 20*a* to be fed to the photosensitive drum 1*a*. The toner attaches, sequentially, to the exposed part of the photosensitive drum 1*a* rotating clockwise, and thereby the electrostatic latent image on the photosensitive drum 1*a* is developed.

Figure 3:
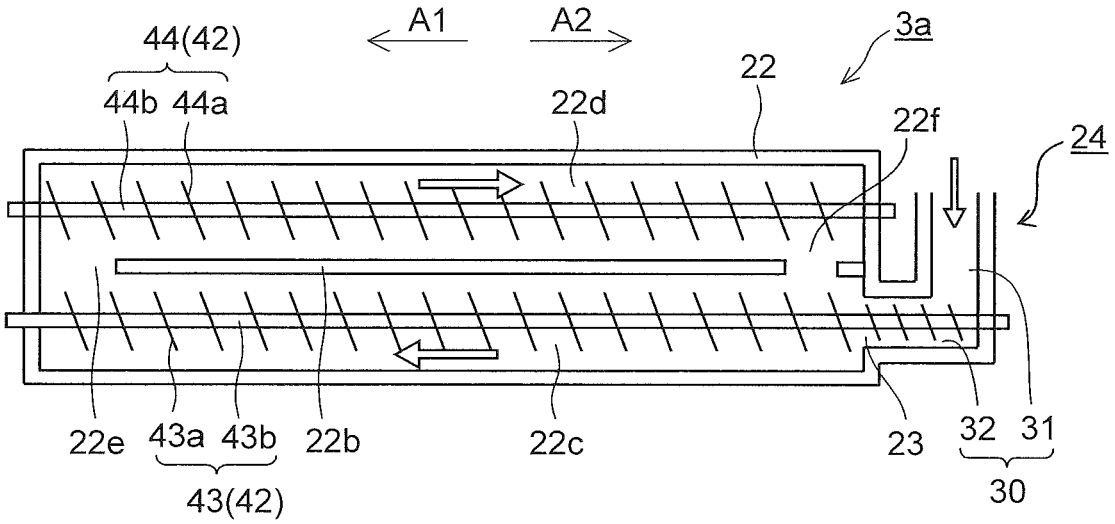
FIG. 3 is a longitudinal sectional view showing a structure of a stirring portion of the developing device.

FIG. 3 is a longitudinal sectional view (as seen from the direction of arrows YY' in FIG. 2) showing the structure of a stirring portion of the developing device 3*a*. As shown in the FIG. 3, in the developer container 22, the partition portion 22*b*, the first and second conveying chambers 22*c* and 22*d*, and the first and second communication portions 22*e* and 22*f* are formed.

The partition portion 22*b* extends in the longitudinal direction of the developer container 22 and partitions it into the first and second conveying chambers 22*c* and 22*d* such that they are located one above the other. The first and second communication portions 22*e* and 22*f* are formed at one and the other ends (at A1- and A2-direction downstream sides), respectively, of the partition portion 22*b* in its longitudinal direction. The first communication portion 22*e* allows the downstream-side end parts of the first and second conveying chambers 22*c* and 22*d* in the A1 direction (the first direction) to communicate with each other. The second communication portion 22*f* allows the downstream-side end parts of the first and second conveying chambers 22*c* and 22*d* in the A2 direction (the second direction) to communicate with each other. The second communication portion 22*f* is formed in a size large enough for the developer conveyed to the second spiral 44 not to stagnate. The developer circulates through the first conveying chamber 22*c*, the first communication portion 22*e*, the second conveying chamber 22*d*, and the second communication portion 22*f*.

The first spiral 43 arranged in the first conveying chamber 22*c* includes a rotary shaft 43*b* and a first helical blade 43*a* which is provided integrally with the rotary shaft 43*b* and which is formed in a helical shape with a predetermined pitch in the axial direction of the rotary shaft 43*b*. The rotary shaft 43*b* is rotatably pivoted on the developer container 22. The first helical blade 43*a* rotates clockwise in FIG. 2 to convey, while stirring, the developer inside the first conveying chamber 22*c* in the A-1 direction (to one side of the developing roller 20 in its axial direction).

The second spiral 44 arranged in the second conveying chamber 22*d* includes a rotary shaft 44*b* and a second helical blade 44*a* which is provided integrally with the rotary shaft 44*b* and which is formed in a helical shape with a blade winding in the same direction (in the same phase) as the first helical blade 43*a*. The rotary shaft 44*b* is arranged parallel to the rotary shaft 43*b*, and is rotatably pivoted on the developer container 22. The second helical blade 44*a* rotates counter-clockwise in FIG. 2 to convey, while stirring, the developer inside the second conveying chamber 22*d* in the A-2 direction (in the direction opposite to the A-1 direction) to feed it to the developing roller 20 (see FIG. 2).

The second communication portion 22*f* is formed at an end part of the partition portion 22*b* in the width direction (arrow X direction) of the developer container 22. More specifically, the second communication portion 22*f* is, as shown in FIG. 2, formed at an end part of the partition portion 22*b* at its side (right side in FIG. 2) where the developer is lifted as the second spiral 44 rotates (counter-clockwise in FIG. 2). Although not illustrated, the first communication portion 22*e* is formed in a middle part of the partition portion 22*b* in the width direction of the container.

In this developing device 3*a*, as shown in FIG. 3, the developer inside the first conveying chamber 22*c* is conveyed, while being stirred, to one side (the first communication portion 22*e* side) by the first spiral 43 and accumulates gradually at one side of the first conveying chamber 22*c*. At the one side of the first conveying chamber 22*c*, the developer is pushed by the succeeding developer to be lifted into the second conveying chamber 22*d* via the first communication portion 22*e*.

Then, the developer is, while being stirred and conveyed to the other side (toward the second communication portion 22*f*) by the second spiral 44, fed to the developing roller 20. The developer on the developing roller 20 unused for development falls off the developing roller 20 to be collected in the second conveying chamber 22*d*. The developer is then conveyed to the other side of the second conveying chamber 22*d* by the second spiral 44 and falls into the first conveying chamber 22*c* via the second communication portion 22*f*.

On the end face of the first conveying chamber 22*c* in the A-2 direction, a toner feeding opening 23 for feeding toner into the developer container 22 is provided. To the toner feeding opening 23, a toner feeding portion 24 connected to the toner container 4*a* (see FIG. 1) is connected. The toner feeding portion 24 includes a toner conveying portion 30 having a vertical conveying portion 31 which vertically conveys toner (makes toner fall) and a horizontal conveying portion 32 which receives toner from the vertical conveying portion 31 and conveys it horizontally.

Figure 4:
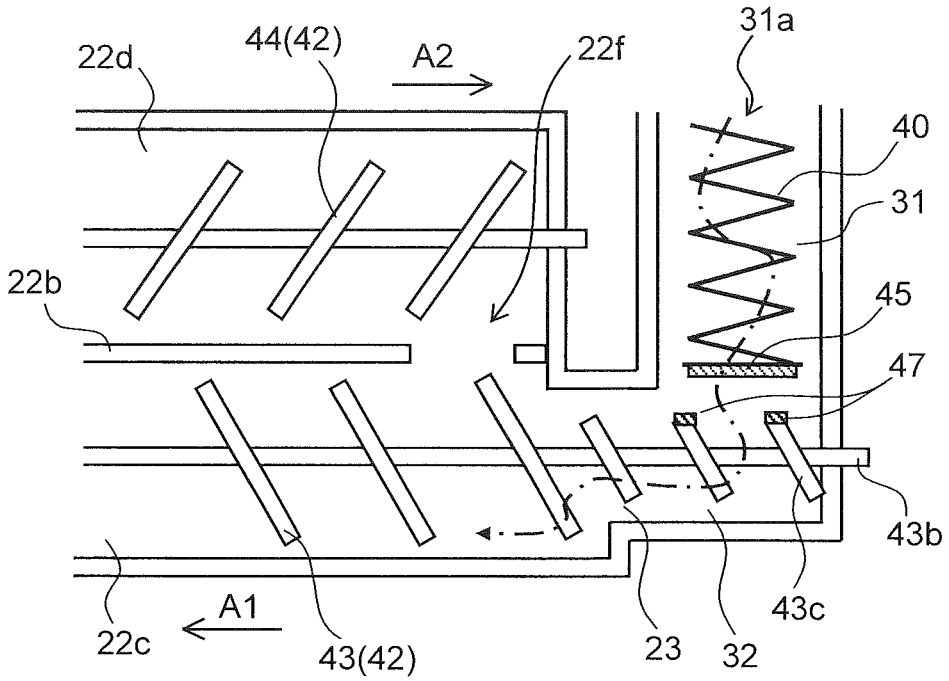
FIG. 4 is a partly enlarged view showing a structure of and around the toner feeding portion according to one embodiment of the present disclosure, which is connected to the developing device.

FIG. 4 is a partly enlarged view showing the structure of and around the toner feeding portion 24 according to one embodiment of the present disclosure, which is connected to the developing device 3*a*. The rotary shaft 43*b* of the first spiral 43 extends, through the toner feeding opening 23, into the horizontal conveying portion 32 in the toner feeding portion 24. A feeding blade 43*c* in a helical shape with a predetermined pitch in the axial direction of the rotary shaft 43*b* is formed integrally with a part of the rotary shaft 43*b* arranged inside the horizontal conveying portion 32. The feeding blade 43*c* is formed as a helical blade winding in the same direction (same phase) as the first helical blade 43*a* but with a smaller pitch and a smaller diameter compared to the first helical blade 43*a*. That is, the first spiral 43 serves also as a conveying member which conveys the toner inside the horizontal conveying portion 32 toward the toner feeding opening 23. In the vertical conveying portion 31, a toner loosening member 40 having the shape of a coil spring is arranged.

The replenishment toner conveyed from the toner container 4*a* (see FIG. 1) into the toner feeding portion 24 via an opening 31*a* at the top end of the vertical conveying portion 31 passes through the vertical conveying portion 31 to fall into the horizontal conveying portion 32. The replenishment toner which has fallen into the horizontal conveying portion 32 is conveyed horizontally (leftward in FIG. 4) by the feeding blade 43*c* of the first spiral 43 and enters the first conveying chamber 22*c* through the toner feeding opening 23 along the rotary shaft 43*b* (as indicated by a dash-dot line in FIG. 4). Then, the developer is stirred and mixed with the developer in the first conveying chamber 22*c* (the developer fallen from the second conveying chamber 22*d*) to be charged to a predetermined amount of charge.

Figure 5:
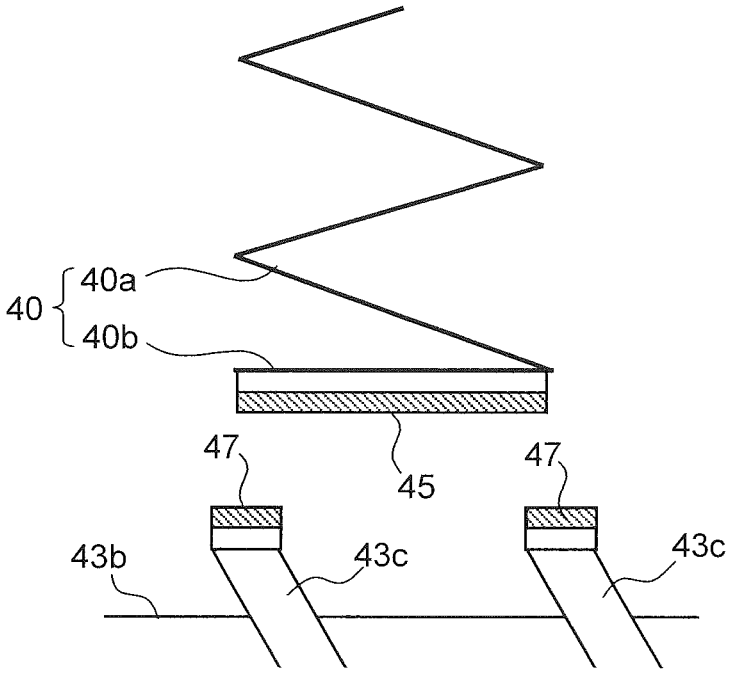
FIG. 5 is an enlarged view of a connecting part between a toner loosening member and a feeding blade in the toner feeding portion of this embodiment.

FIG. 5 is an enlarged view of a part where the toner loosening member 40 and the feeding blade 43*c* in the toner feeding portion 24 of this embodiment face each other. The toner loosening member 40 is formed by bending a metal wire (spring material) into a coil shape and includes a coil portion 40*a* extending vertically and an annular portion 40*b* formed at the bottom end of the coil portion 40*a*. The toner loosening member 40 is given a diameter smaller than the inner diameter of the vertical conveying portion 31, and the toner loosening member 40 is arranged so as to be vertically movable inside the vertical conveying portion 31. To the annular portion 40*b* of the toner loosening member 40, a first magnetic member 45 is attached. To the outer circumferential edge of the feeding blade 43*c*, at a part facing the toner loosening member 40 (annular portion 40*b*), a second magnetic member 47 is attached.

Figure 6:
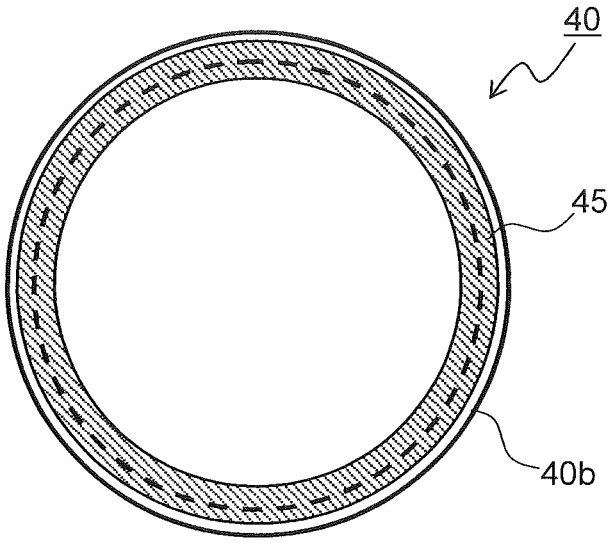
FIG. 6 is a plan view of the toner loosening member as seen from an annular portion side.

FIG. 6 is a plan view of the toner loosening member 40 as seen from the annular portion 40*b* side. The first magnetic member 45 is in a ring shape having substantially the same diameter as the annular portion 40*b* and is fixed to the annular portion 40*b* so as to overlap with it. The magnetic pole of the first magnetic member 45 on its side (indicated by hatching in FIG. 5) facing the feeding blade 43*c* is the same as the magnetic pole of the second magnetic member 47 on its side (indicated by hatching in FIG. 5) facing the toner loosening member 40. For the first and second magnetic members 45 and 47, any of magnets formed of various magnetic materials, such as ferrite magnets, neodymium magnets, and plastic magnets, can be used.

Figure 7:
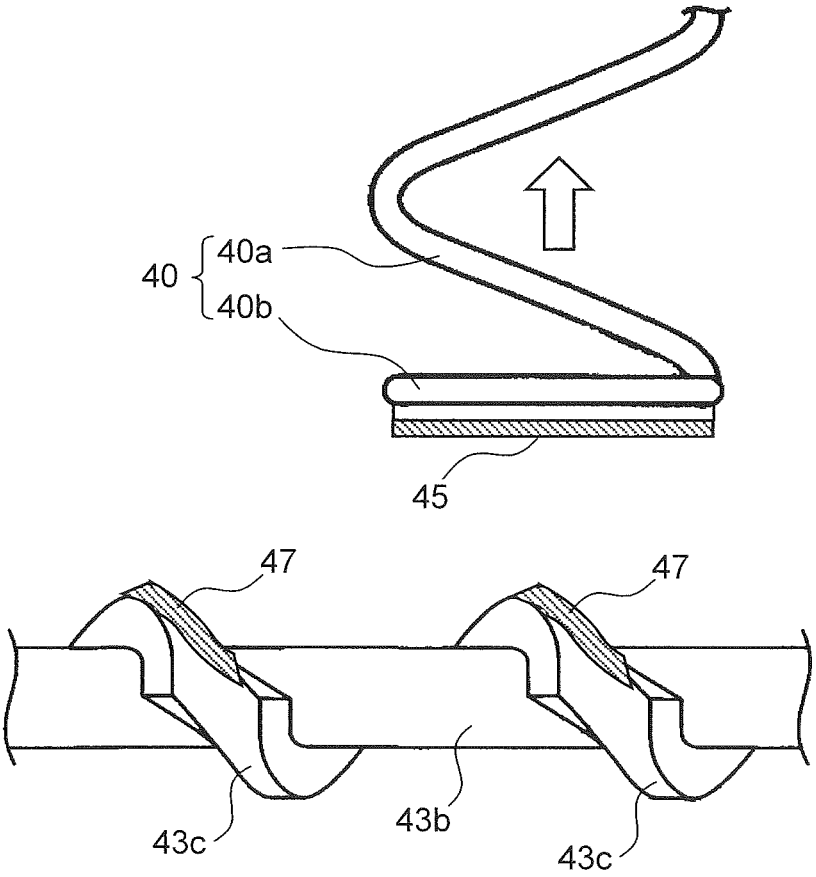
FIG. 7 is a diagram showing a state where, in the toner feeding portion of this embodiment, first and second magnetic members face each other with the rotation of a first spiral to make the toner loosening member ascend.
Figure 8:
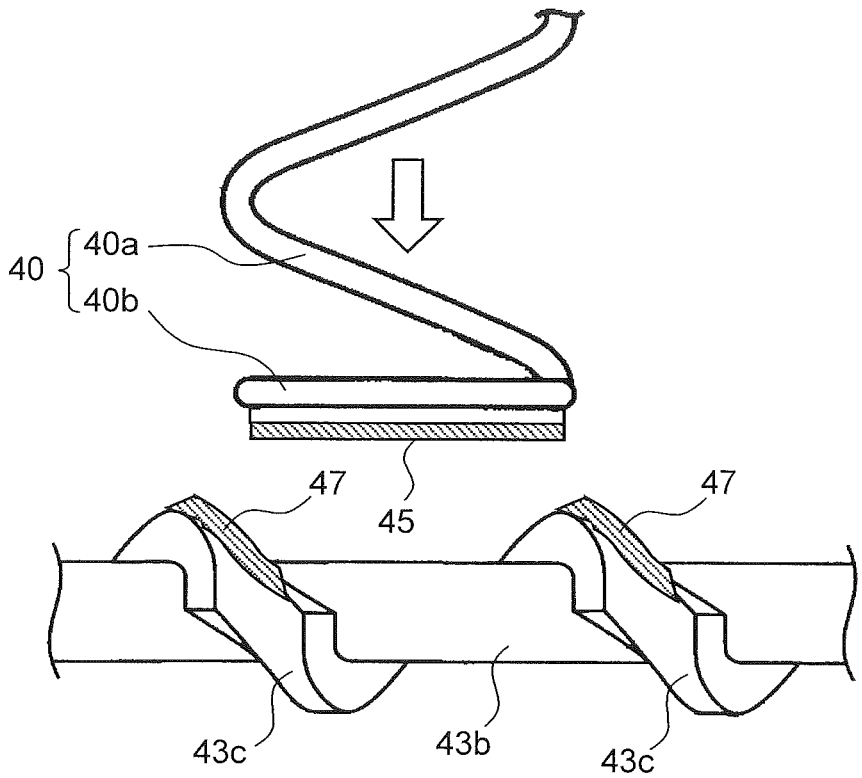
FIG. 8 is a diagram showing a state where the first spiral rotates through 180° from a state in FIG. 7 to make the toner loosening member descend.

FIGS. 7 and 8 are schematic diagrams illustrating the ascending and descending operation of the toner loosening member 40. FIG. 7 shows a state where the first magnetic member 45 on the toner loosening member 40 is close to the second magnetic member 47 on the feeding blade 43*c*. In this state, the overlap between the first and second magnetic members 45 and 47 is large and the repulsive magnetic field between the first and second magnetic members 45 and 47 is strong; thus the toner loosening member 40 ascends.

FIG. 8 shows a state where the first magnetic member 45 on the toner loosening member 40 is away from the second magnetic member 47 on the feeding blade 43*c*. When the first spiral 43 rotates by a predetermined amount from the state in FIG. 7, the phase of the feeding blade 43*c* shifts. For example, when the first spiral 43 rotates through 180°, the phase of the feeding blade 43*c* shifts by ½ of the pitch. As a result, the position of the second magnetic member 47 which has been close to the first magnetic member 45 moves in the axial direction of the rotary shaft 43*b* and, as shown in FIG. 8, the first magnetic member 45 is arranged between the second magnetic members 47. In this state, the overlap between the first and second magnetic members 45 and 47 is small and the repulsive magnetic field between the first and second magnetic members 45 and 47 is weak; thus the toner loosening member 40 descends under its own weight.

When the first spiral 43 further rotates through 180° from the state in FIG. 8, it returns to the state in FIG. 7. That is, each time the first spiral 43 rotates one turn, the first and second magnetic members 45 and 47 move close to and away from each other, and this repeats on and on; meanwhile the repulsive magnetic field between the first and second magnetic members 45 and 47 repeats changing periodically from strong to weak then back to strong and so forth. According to such periodical change of the repulsive magnetic field between the first and second magnetic members 45 and 47, also the toner loosening member 40 reciprocates vertically.

With this, inside the vertical conveying portion 31, scraping operation with the reciprocating movement of the toner loosening member 40 continues being performed all the time, and it is thus possible to prevent toner from agglomerating in the vertical conveying portion 31. It is thus possible to smoothly feed toner from the toner containers 4*a* to 4*d* to the developing devices 3*a* to 3*d*.

The toner loosening member 40 can reciprocate vertically only with the rotating operation of the first spiral 43, and thus no separate driving source for moving the toner loosening member 40 is necessary. Thus, agglomeration of toner in the vertical conveying portion 31 can be effectively prevented with a low-cost and simple structure.

It is preferable that the first and second magnetic members 45 and 47 be given such a magnetic force as to generate a repulsive magnetic field strong enough for the toner loosening member 40 not to make contact with the first spiral 43 (feeding blade 43*c*) even when the toner loosening member 40 descends under its own weight as shown in FIG. 8. With this, the toner loosening member 40 and the feeding blade 43*c* do not make contact with each other during the rotation operation of the first spiral 43, and thus no frictional heat results from contact between the toner loosening member 40 and the feeding blade 43*c*. This can prevent toner from melting by frictional heat to agglomerate.

Although the ring-shaped first magnetic member 45 which overlaps with the annular portion 40*b* of the toner loosening member 40 is used in this embodiment, the shape of the first magnetic member 45 is not limited to this, and may instead be in any other shape. Moreover, although the second magnetic member 47 is attached only to the outer circumferential edge of the feeding blade 43*c* in this embodiment, it may instead be attached to the entire surface of the feeding blade 43*c* so long as a configuration is adopted in which the repulsive magnetic field between the first and second magnetic members 45 and 47 can be changed periodically. The second magnetic member 47 may even be attached to the outer circumferential face of the rotary shaft 43*b* in addition to the feeding blade 43*c*.

Figure 9:
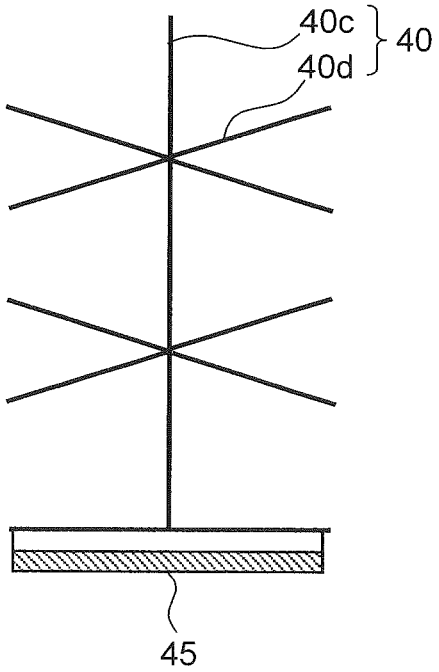
FIG. 9 is a side view showing a modified example of the toner loosening member.

The embodiment described above is in no way meant to limit the present disclosure, which thus allows for many modifications and variations within the spirit of the present disclosure. For example, the above embodiment deals with an example of using, as the toner loosening member 40, one having a shape of a coil spring. This is a merely example, and, for example, a toner loosening member 40 like the one shown in FIG. 9 may instead be used which has protruding pieces (or protruding strips) 40*d* extending radially from a vertically extending core member 40*c*.

Although the first spiral 43 having the helical feeding blade 43*c* continuously formed around the rotary shaft 43*b* is used in the above embodiment, the feeding blade 43*c* is not limited to a helical blade. For example, a feeding blade 43*c* having a plurality of semicircular plates (circular plates divided into two parts) arranged alternately around the rotary shaft 43*b* at a predetermined inclination angle may be used.

Although the above embodiment deal with a configuration where toner is fed to the developing devices 3*a* to 3*d* having a first conveying chamber 22*c* and a second conveying chamber 22*d* that is arranged above the first conveying chamber 22*c*, a configuration is also possible where toner is fed to the developing devices 3*a* to 3*d* in which the first and second conveying chambers 22*c* and 22*d* are arranged side by side. Although the above embodiment deals with an example where developer is fed from the second spiral 44 to the developing roller 20, this is not meant to limit the present disclosure. A configuration is also possible where a developer carrier such as a magnetic roller is further provided between the second spiral 44 and the developing roller 20, and after developer is fed from the second spiral 44 to the magnetic roller and the like, toner is fed from the magnetic roller and the like to the developing roller 20.

Although the above embodiment deals with the toner feeding portion 24 which feeds toner from the toner containers 4*a* to 4*d* to the developing devices 3*a* to 3*d*, the application target of the present disclosure is not limited to the toner feeding portion 24. For example, the present disclosure is applicable to any toner conveying devices in which the horizontal conveying portion is arranged downstream of the vertical conveying portion, such as a waste toner conveying device which conveys waste toner from the cleaning devices 7*a* to 7*d* (see FIG. 1) to a waste toner collection container (unillustrated).

The present disclosure is applicable not only to a tandem-type color printer 100 such as the one shown in FIG. 1, but also to various types of image forming apparatuses having a toner conveying device in which a horizontal conveying portion is arranged downstream of a vertical conveying portion, such as digital and analogue monochrome copiers, color copiers, and facsimile machines.

The present disclosure is applicable to any toner conveying devices having a vertical conveying portion and a horizontal conveying portion connected to a bottom end part of the vertical conveying portion. Based on the present disclosure, it is possible to provide a toner conveying device which can prevent toner from agglomerating in the vertical conveying portion and which can thereby convey toner smoothly, as well as to provide a developing device and an image forming apparatus incorporating such a toner conveying device.

What is claimed is:

1. A toner conveying device, comprising:

a toner conveying portion including a vertical conveying portion which conveys toner by making toner fall vertically and a horizontal conveying portion which is connected to a bottom end part of the vertical conveying portion to convey toner horizontally;

a conveying member including a rotary shaft arranged in the horizontal conveying portion along a conveying direction of the toner and a conveying projection which is provided around an outer circumferential face of the rotary shaft, the conveying member conveying, with the conveying projection while rotating the rotary shaft, the toner in the horizontal conveying portion in an axial direction of the rotary shaft;

a toner loosening member arranged in the vertical conveying portion so as to be movable vertically;

a first magnetic member attached to a bottom end part of the toner loosening member; and a second magnetic member attached to a part of the conveying member facing the toner loosening member, wherein a magnetic pole of the first magnetic member on a side thereof facing the conveying member is same as a magnetic pole of the second magnetic member on a side thereof facing the toner loosening member, and the toner loosening member vertically reciprocates as a repulsive magnetic field between the first magnetic member and the second magnetic member changes periodically with rotation of the conveying member.

2. The toner conveying device according to claim 1, wherein the toner loosening member vertically reciprocates while maintaining a non-contact state with the conveying member.

3. The toner conveying device according to claim 1, wherein the second magnetic member is attached to at least an outer circumferential edge of the conveying projection.

4. The toner conveying device according to claim 1, wherein the conveying member is a conveying screw including a helical blade formed as the conveying projection on an outer circumferential face of the rotary shaft.

5. The toner conveying device according to claim 1, wherein the toner loosening member includes a coil portion which extends vertically and an annular portion which is formed at a bottom end of the coil portion and to which the first magnetic member is fixed.

6. A developing device comprising:

a developer container for storing developer including toner;

a developer carrier which is rotatably supported on the developer container, the developer carrier carrying the developer in the developer container and the toner conveying device according to claim 1 connected, as a toner feeding portion for feeding toner to the developer container.

7. An image forming apparatus comprising the toner conveying device according to claim 1.

* * * * *